United States Patent [19]

Thiel et al.

[11] 3,979,251

[45] Sept. 7, 1976

[54] APPARATUS FOR PRODUCING A PILE CARPET

[75] Inventors: Rudolf Thiel, Hameln; Kurt Witt, Coppenbrugge, both of Germany

[73] Assignee: Firma Otto Golze & Sohne, Kokosweberei, Hameln, Germany

[22] Filed: Mar. 5, 1975

[21] Appl. No.: 555,913

[30] Foreign Application Priority Data

Mar. 6, 1974 Germany ..... 2410710

[52] U.S. Cl. ..... 156/435; 156/72

[51] Int. Cl.[2] ..... B32B 5/00

[58] Field of Search ..... 156/72, 161, 435, 436, 156/440

[56] References Cited

UNITED STATES PATENTS

| | | | |
|---|---|---|---|
| 1,314,529 | 9/1919 | Marche | 156/72 |
| 2,792,051 | 5/1957 | Jacquet | 156/72 |
| 3,477,889 | 11/1969 | Partensky | 156/72 |
| 3,839,114 | 10/1974 | Schmidt et al. | 156/72 |

FOREIGN PATENTS OR APPLICATIONS

| | | | |
|---|---|---|---|
| 168,743 | 9/1959 | France | 156/435 |

*Primary Examiner*—William A. Powell
*Assistant Examiner*—John E. Kittle
*Attorney, Agent, or Firm*—Pollock, Vande Sande & Priddy

[57] ABSTRACT

Production of pile fabric with repetitive cutting of incremental lengths of fiber with a moveable cutter. The increments are sequentially packed onto a guide, such as a shaft conveyor, and then delivered to and implanted on an adhesive coated carrier or backing moving on a carrier conveyor. To prevent disordering of the fibers, the fiber is caused to retract from the cutter upon retraction of the cutter.

15 Claims, 2 Drawing Figures

APPARATUS FOR PRODUCING A PILE CARPET

The invention relates to an apparatus for producing a pile carpet, with feed means for the stepwise feeding of a web of fibres, threads or yarns (of a warp) to a cutting apparatus having one cutting edge disposed rigidly beneath the warp and an upwardly and downwardly movable cutting edge disposed above and constructed preferably in one piece with a pusher to push the pile strip which has been cut off into a conveyor shaft, the upper region of which is aligned (vertically) with respect to the cutter and which merges via an arc into a substantially horizontal zone which discharges approximately tangentially above a conveyor for pile carpet carrier material, so delivering the web of pile strips continuously onto the carrier material.

In other words, strips of pile fibres are cut from the substantially horizontally disposed warp and pushed into the conveyor shaft, in which therefore a solid pile web is formed and is deflected via the aforesaid arc and, at the horizontal delivery end of the conveyor shaft, is supplied to the carrier material which is propelled in the same direction. The carrier material is preferably a still pasty synthetic resin into which the bottom ends of the pile fibres more or less penetrate so that they are anchored therein following solidification or hardening of the synthetic resin.

In this way, it is possible to produce pile carpets of various types and from all manners of materials, the pile carpets then being cut to the desired size. In particular, for example, door mats of coconut fibres can be produced in this way.

It has now been found that the machine functions better and substantially trouble-free, and the quality of the product is better, if before each upwards movement of the movable cutter, the warp is withdrawn from contact with the cutter. This is probably due to the fact that during its upwards movement, the cutter has a tendency to disorder the fibres at the free end of the warp. At the moment of cutting, the free ends of the warp are pressed tightly against the back of the cutter and are thereby bent somewhat downwards. The cutter then has a tendency, during the upwards stroke, to take the ends of the warp upwardly with it, so disorganising the end of the warp. The exactly parallel orientation of the warp threads or fibres is adversely affected, producing difficulty with the subsequent stages of the process. Individual fibres may be laid transversely or obliquely and thus interfere with the adjacent fibres, resulting in faults which are visible on the pile carpet.

An object of the invention is to overcome these difficulties, by constructing the apparatus so that the ends of the warp are not adversely affected by the upwardly moving cutter, whereby the pile fibres are orientated parallel with and alongside one another and reach the carrier material in this orientation. According to the invention, the solution to this problem resides in the provision of an apparatus which, before each retraction or upwards stroke of the movable cutter, withdraws the free end of the warp from contact with the cutter.

For this purpose, a particular "retractor device" may be provided, for example two pneumatically operated bars which rhythmically grip the warp between them and retract it somewhat. According to the invention, it is suggested that, at every upwards stroke of the movable cutter, the feed means be relesed for a rearwards movement or become disengaged from the warp. In this way, the feed means causes retraction of the warp. The end of the warp need only be retracted by a small amount, a few tenths of a millimeter being sufficient. This slight movement can be achieved by simply relaxing the entire warp. It is necessary only, at the moment of upwards travel of the cutter, to release the tension or force being exerted on the warp by the feed elements so that the warp becomes relaxed, the end of the warp being retracted by the small amount required.

In a further development of the invention, a feed roller is provided on which there is a reciprocatingly propelled pivoting lever which, at every forward movement, drives the feed roller in the direction of feed by the particular increment length of pile required, whereas during the reverse travel of the pivoting lever, the driving connection to the feed roller is broken by an interposed freewheeling or like device.

The feed roller must then be driven rhythmically, in synchronism with the cutter. According to the invention, a surprisingly simple drive is provided by the pivoting lever being connected through a push rod to a cam drive which, in a manner which is known per se, drives the vertically guided cutter bar.

Therefore, according to the invention, the feed roller which is necessary anyway is at the same time and by means of the aforesaid freewheeling device, utilised for retraction of the warp end, the feed roller being driven via said pivoting lever and push rod by the cam drive of the cutter bar, so that no additional drive is required.

The invention goes beyond this in that a depressor, which is known per se, is disposed between feed roller and cutter, and is likewise driven by the shaft which drives the cutter bar, through the same or through a further eccentric means. Thus, a further crank disc may also be provided to drive the depressor.

After each forward movement or each cut, the depressor tenses the warp between it and the feed table and releases the warp again after each cut, for renewed feeding. Therefore, the depressor leads the cutter, and which means that is applied onto the warp before cutting and is lifted therefrom again before the cutter is raised. When the depressor is lifted, the freewheeling device on the drive roller also becomes effective, so that the warp can relax and so pull back from the upgoing cutter.

The depressor is preferably mounted at the bottom end of a vertically guided rod, on the upper end of which there is a horizontal arm incorporating an elongated hole or a link which is engaged by a sliding block mounted on the associated crank disc.

In order to achieve smooth operation, it is preferred to interpose a thrust spring into the drive train.

As a further development of the invention, it is suggested that a presser bar acting on the upper face of the pile and moving in the same rhythm as the pile web, provided preferably directly after the point of emergence of the pile web from the conveyor shaft. This pressure bar presses rhythmically on the pile fibres so that these latter are impressed more intensely into the plastic carrier material in which they become more firmly anchored.

This presser bar is usable independently of the other parts of the apparatus. It is however particularly advantageous to use it in co-operation with the described retraction of the fibre web before the upwards movement of the cutter. As explained, this achieves better parallelism of the fibres so that the perpendicularly orientated fibres withstand the pressure exerted by the presser bar and are so impressed into the plastic binder without being bent over or laid obliquely, which would produce faults.

Preferably, the presser bar is connected to the cutter bar and is thus driven by the latter, so that no additional drive elements are required.

The densest possible pile is desirable in pile carpet. With a dense pile, however, the individual fibres penetrate less readily into the viscous binder. The presser bar exerts on the pile the greater force needed to achieve such penetration. However, to create a dense pile, the pile increments which are cut off must be pushed or pressed firmly into the conveyor shaft. The pile strips have a tendency to spring back, adversely affecting the cutting work. It is known to provide barb-like teeth in the upper entrance to the conveyor shaft. According to the invention, cross-sectionally inwardly projecting barb-like projections are also provided lower down, on at least one of the two shaft walls. In this way, the pressure which builds up in the pile web during compression thereof is absorbed in stages. A particularly simple employs a fixed cutter which is of double-edged construction, so that whichever edge is used as the bottom edge projects like a barb into the cross-section of the conveyor shaft. Furthermore, at least one rectangular or sharply-edged recess is provided on the cutter, behind which the pile fibres can be hooked or supported.

The pressure exerted on the pile fibres when they are pushed into the conveyor shaft should be utilised for compression of the pile web, but not be consumed by friction against the walls of the shaft. The walls of the shaft are therefore intended to guide and form the pile web securely without offering any considerable frictional resistance to it. With this in mind, and according to a further development of the invention, it is proposed that the "upper" wall of the conveyor shaft which faces the outer or upper sides of the pile be formed by an elastically flexible plate which is applied by thrust screws against the pile web, while the oppositely disposed "lower" wall of the conveyor shaft is rigid.

An example of the invention will be described hereinafter with reference to the diagrammatic drawings, further important features becoming evident therefrom and being better explained in conjunction with the description. In the appended drawings.

Figure 1:
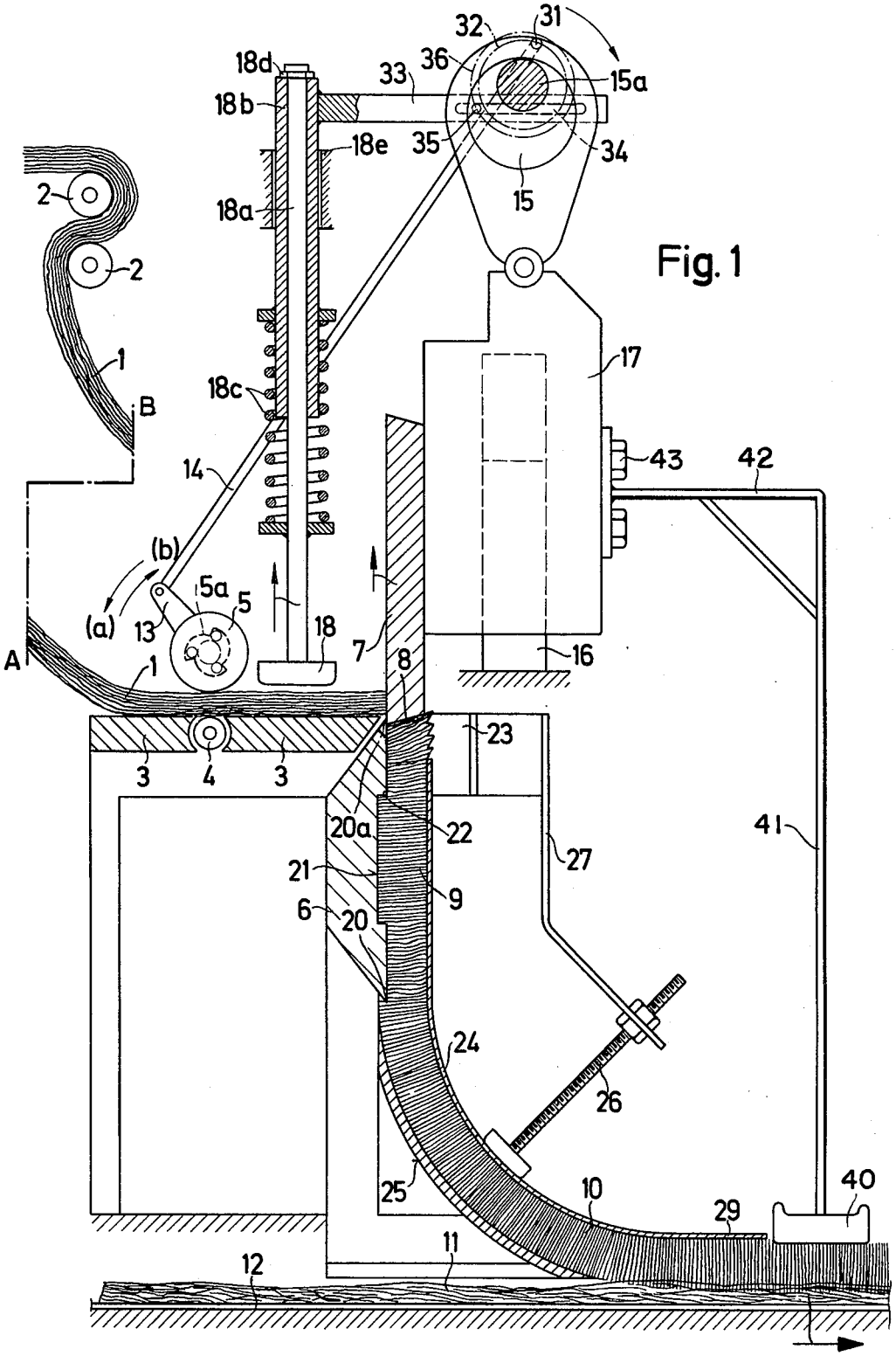
FIG. 1 is a diagrammatic view of the apparatus in side elevation.

The warp 1 extends from top deflector rollers 2 onto a horizontal feed table 3 and between two feed rollers 4, 5 to the cutting device constituted by a fixed cutter 6 and an upwardly and downwardly moveable cutter 7. During advancement or downwards movement of top cutter 7, a strip, i.e. an increment of length of pile 8, is cut off and pushed into a first conveyor mean, e.g. an arcuately or knee-shaped conveyor shaft 9. In this first conveyor means the pile web is compressed and finally delivered at the substantially horizontal outlet portion 10, from which it is fed more or less tangentially onto a plastic carrier material or binder 11 carried on a second conveyor means, e.g. conveyor belt 12, propelled in the same direction.

The bottom roller 4, freely rotatable, is disposed at the height of the table and bears against the underside of the warp 1. Cooperating with it, for stepwise feeding and withdrawing of the warp, is the feed roller 5 which rests on the upper side of the warp and which is driven by a reciprocating pivoting lever 13. The drive for the feed roller 5 is derived from the drive shaft 15*a* which operates the cutter bar 17. On the pivoting lever 13 is a push rod 14, the upper end of which is articulated by means of pin member 31 on a crank disc 32 which is mounted on the drive shaft 15*a*.

In (a), one direction of movement of the pivoting lever 13, the warp 1 is advanced by an increment corresponding to the length of the pile fibres or threads. In (b), the other direction of movement, the driving connection between the pivoting lever 13 and feed roller 5 is broken; for this purpose, a freewheeling device 5*a* is preferably interposed between the hub of the pivoting lever 13 and the roller 5. In consequence, the feed roller 5 is freely rotatable. Therefore, it exerts no force on the warp 1, i.e. the warp 1 is relieved of the previously effective feed force. The warp 1 relaxes causing its leading or fee end to retract by a small amount so that it is disengaged from the top cutter 7; therefore, the ends of the warp can no longer be entrained upwardly by the upwardly moving top cutter and so become disordered.

This effect can be further improved if the warp 1 extends obliquely downwardly as shown in FIG. 1, so that the sag in the warp endeavors to retract it. To conserve space in the drawing a portion of the obliquely extending warp has been cut away and moved, with rollers 2, as indicated by reference line A-B.

Provided between the feed roller 5 and the cutter 7 is a depressor 18 which is known per se and is likewise drivingly connected to the drive shaft 15*a*. The depressor 18 leads the top cutter 7 so that before every cut the depressor 18 comes to rest on the warp 1 in order to hold it securely during the cutting operation, whereas when the cutting is completed, the depressor 18 is already taken off, so that the end of the warp 1 can retract from the cutter 7 in the desired manner.

The push rod 18*a* for the depressor 18 is guided in a sleeve 18*b* which is in turn vertically guided in a guide 18*e* mounted on the machine frame. The sleeve 18*b* is engaged by a horizontal arm 33 with a link or elongated hole 34, the said link 34 being engaged by a sliding block 35 which is mounted on a further crank disc 36 mounted on the drive shaft 15*a*.

Incorporated into the drive train is a thrust spring 18*c* which is supported between an abutment on the push rod 18*a* and an abutment on the sleeve 18*b*. A further abutment 18*d* is provided on that end of the push rod 18*a* which projects upwardly from the sleeve 18*b*.

Figure 2:
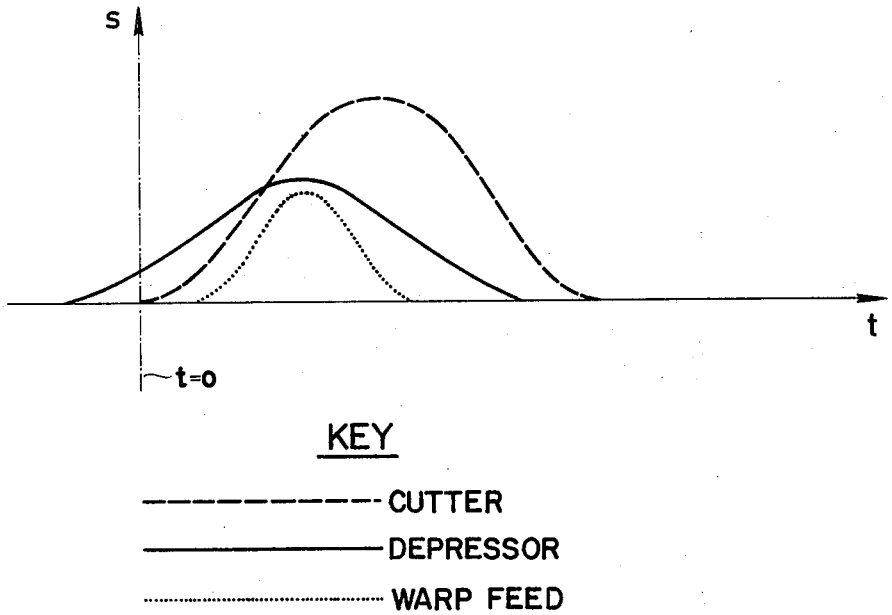
FIG. 2 is an associated path-time diagram.

The travel of the cutter 7 and of the depressor 18 and also the amount of feed can be adjusted relatively easily at the cam or crank discs. Also, the displacement of these movements with respect to timing can be varied relatively easily. FIG. 2 shows the associated path-time diagram, showing the distances or strokes travelled by the cutter member 7, depressor 18 and lever 13, with respect to the time $t$. At $t = 0$, with the machine in the position shown in FIG. 1, in which the cutter 7 is in bottom dead centre position with the feed roller 5, still idling while the depressor 18 is already lifted off the warp; the warp can therefore relax and retract from the cutter 7. The upwards movement of the cutter 7 now commences, followed by the feed movement (a) of the push rod 14 or feed roller 5.

The fixed bottom cutter 6 is double-edged which means that both sides can be used. It is so disposed that whichever edge is used as the lower cutting edge 20 projects barb-like into the conveyor shaft 9, whereby pile strips can be braced against it and cannot travel back any farther. Between the two edges of the bottom cutter 6 is an elongated recess 21 and the edge 22 thus formed provides a further supporting point farther down the conveyor shaft.

Opposite whichever is the top cutting edge 20*a* there is a serrated strip 23, behind the teeth of which the pile fibres can likewise become hooked. Thus there are a plurality of supporting points for the pile which is increasingly compressed in the direction of conveyance. The points act more or less like a non-return valve. The upper and/or lower walls 24 of the shaft 9 are formed by a flexible plate. In this embodiment the oppositely disposed lower wall 25 is rigid. The flexible sheet metal wall 24 is held in the desired shape by thrust screws 26 and caused to bear on the pile web. In this way, the conveyor shaft 9 adapts itself constantly to the pile web which therefore suffers only negligible frictional resistance while being nevertheless securely guided. The pressure-applying screws 26 are held by elastic pressure-applying arms 27 mounted on the strip 23.

Immediately adjacent to the end 29 of the conveyor shaft 9 there is a pressure bar 40 which acts on the upper side of the emerging pile web, impressing the bottom ends of the fibres lightly into the plastic binder 11. The presser bar 40 is connected via a rod 41 and an arm 42 to the cutter bar 17 and is therefore likewise driven by this latter. The arm 42 is capable of being vertically displaced and locked on the cutter bar 17 for example by means of an elongated hole and screws 43. The nature of the linkage connection 41, 42 is such that the pressure exerted by the presser bar 40 is elastic and gentle, and additional spring elements, particularly thrust springs, may be provided.

We claim:

1. Apparatus for producing pile fabric with step-wise feeding and withdrawing of the free end of a warp composed of fibers, thread or yarn, said apparatus comprising: feed means positioned to feed said warp; cutting apparatus positioned to receive said warp from said feed means, including a moveable cutting member and means for advancing said cutting member for cutting increments of length of said warp and for retracting said cutting member for advancement of additional increments of said warp into cutting position; means for pushing cut increments of warp into a first conveyor means for transporting the cut increments to a second conveyor; means for causing withdrawal of the free end of the warp from contact with said cutting member before retraction of said cutting member; and a second conveyor means for carrying a pile fabric carrier material, positioned to receive said cut increments from said first conveyor; whereby withdrawal of said warp reduces disorganization of the fibers, thread or yarn in the warp increments delivered to the second conveyor.

2. Apparatus according to claim 1, wherein the means for causing withdrawal of the free end of the warp includes means for releasing or disengaging said feed means from said warp for rearward movement thereof.

3. Apparatus according to claim 2, wherein the feed means includes a roller connected with a reciprocating pivoting lever for driving said roller, said lever being moveable in one direction (a) for driving said roller in the direction of feed by the length of said increments and in the opposite direction (b) on return stroke, said roller and lever being connected by means for breaking the driving connection between them on said return stroke.

4. Apparatus according to claim 3, wherein said lever is connected with a push rod actuated by a cam on a shaft for driving said cutting member.

5. Apparatus according to claim 3, wherein said lever is connected through a push rod with a crank disc on a shaft for driving said cutting member.

6. Apparatus according to claim 2 wherein the feed means includes a feed roller, and the means for causing withdrawal of the free end of the warp includes depressor means stationed between said roller means and said cutting member for gripping said warp, and means for disengaging said depressor before retracting of said cutting member.

7. Apparatus according to claim 6 wherein said depressor means and said cutting member are interconnected for causing downward and upward motion of the depressor means in advance of the cutting member.

8. Apparatus according to claim 7 in which the interconnection of the cutting member and depressor means includes a push rod connected between said depressor means and an arm having an elongated hole engaged by a sliding block means mounted on a crank disc having a driving connection with said cutting member.

9. Apparatus according to claim 8 in which said push rod engages a sleeve in a vertical guide, said push rod being displaceable in said sleeve against the action of a thrust spring.

10. Apparatus according to claim 1 including a presser bar, positioned where said cut increments emerge from said first conveyor means, for pressing said increments into contact with said pile fabric carrier material, and means for driving said presser bar in rhythm with said cutting member.

11. Apparatus according to claim 10 wherein the driving means for said presser bar is a linkage connecting said presser bar to said cutting member.

12. Apparatus according to claim 1 wherein said first conveyor means includes a first wall adjacent to those ends of said increments which correspond to the upper face of the pile, said first wall being a resilient plate held against said increments by means for exerting adjustable pressure thereon.

13. Apparatus according to claim 1 in which the cutting apparatus includes a fixed cutter member having two cutting edges, one of which is positioned for cutting said increments in cooperation with said moveable cutting member, and the other of which projects in the form of a barb into said first conveyor means, said fixed cutter having at least one substantially rectangular recess on its side facing the interior of said first conveyor means.

14. Apparatus according to claim 1 wherein said first conveyor means includes a first wall adjacent to those ends of said increments which correspond to the upper face of the pile, said first wall including a lower portion which is a resilient plate held against said increments by means for exerting adjustable pressure thereon and an upper portion which is a toothed portion for retention of said increments; said cutting apparatus further including a fixed cutter member having two cutting edges, one of which is positioned for cutting said increments in cooperation with said cutting member and the other of which projects in the form of a barb into said first conveyor means for retention of said increments, said fixed cutter being positioned opposite said toothed strip and having at least one substantially rectangular recess on its side facing the interior of said first conveyor means for retention of said increments.

15. Apparatus according to claim 1 in which said cutting apparatus includes a fixed cutter member which is disposed beneath the path traversed by the warp in position for cutting said warp in cooperation with said moveable cutting member, said moveable cutting member being disposed for upward and downward motion, and for pushing said cut increments of warp into said first conveyor means, said first conveyor means being a conveyor shaft vertically aligned with said moveable cutting member and describing an arc which merges, tangentially, in a substantially horizontal zone, with said second conveyor means, said means for causing withdrawal of the free end of the warp being a means for releasing or disengaging the means which feeds said warp, for rearward movement of said warp.

* * * * *